US008074413B2

(12) United States Patent
Stein

(10) Patent No.: US 8,074,413 B2
(45) Date of Patent: Dec. 13, 2011

(54) FOUNDATION FOR METALOG BUILDINGS

(76) Inventor: Alejandro Stein, Crans-Pres-Celigny (CH)

( * ) Notice: Subject to any disclaimer, the term of this patent is extended or adjusted under 35 U.S.C. 154(b) by 215 days.

(21) Appl. No.: 12/387,976

(22) Filed: May 11, 2009

(65) Prior Publication Data

US 2010/0281799 A1 Nov. 11, 2010

(51) Int. Cl.
*E04B 1/10* (2006.01)

(52) U.S. Cl. ..... 52/233; 52/293.1; 52/582.1

(58) Field of Classification Search ..... 52/233, 52/293.1, 309.15, 309.16, 309.17, 582.1, 52/592.6, 844
See application file for complete search history.

(56) References Cited

U.S. PATENT DOCUMENTS

| | | | | |
|---|---|---|---|---|
| 1,971,994 | A | 8/1934 | Smith | |
| 2,402,876 | A * | 6/1946 | Dennis | 52/155 |
| 2,635,303 | A * | 4/1953 | Poynter | 446/106 |
| 4,288,954 | A * | 9/1981 | O'Donnell | 52/233 |
| 4,619,089 | A | 10/1986 | Stein | |
| 5,253,458 | A * | 10/1993 | Christian | 52/233 |
| 5,282,343 | A | 2/1994 | Stein | |
| 5,685,116 | A * | 11/1997 | Bradshaw et al. | 52/311.1 |
| 5,782,046 | A * | 7/1998 | Karlsson | 52/233 |
| 7,444,786 | B2 * | 11/2008 | Morgenstern | 52/233 |
| 2002/0121055 | A1 * | 9/2002 | Englehart | 52/233 |
| 2003/0200710 | A1 * | 10/2003 | Gil | 52/233 |
| 2004/0182023 | A1 | 9/2004 | Chambers | |
| 2004/0187411 | A1 * | 9/2004 | Clegg | 52/233 |
| 2007/0137122 | A1 * | 6/2007 | Peaco | 52/233 |
| 2007/0175129 | A1 * | 8/2007 | Nordli | 52/233 |
| 2008/0083177 | A1 * | 4/2008 | Tiberi et al. | 52/233 |

FOREIGN PATENT DOCUMENTS

WO WO 2004/113636 A2 12/2004

* cited by examiner

*Primary Examiner* — Basil Katcheves
*Assistant Examiner* — Branon Painter
(74) *Attorney, Agent, or Firm* — Donald S. Dowden

(57) ABSTRACT

A foundation for a building superstructure has a number of hollow foundation tubes laid horizontally on the ground and susceptible to degradation over time by contact with the ground. Each tube is protected by one or both of the following: (1) a reinforcement housed within the tube, shaped conformably to the interior of the tube, and resistant to degradation by contact with the ground; and (2) a membrane surrounding the tube, shaped conformably to the exterior of the tube, and resistant to degradation by contact with the ground. The tubes are arranged to form the footprint of a small building. In completing the building superstructure, other tubes, which need not have the same protection, are stacked on the foundation tubes. Degradation of the foundation tubes over time because of their contact with the ground is rendered inconsequential by the reinforcement or prevented by the membrane.

16 Claims, 16 Drawing Sheets

42
14
10
38
18
22
36
40

42
14
10
38
18
40
22
36

42
14
10
40
38
18
22
36

42
14
40
10
38
18
22
36

FOUNDATION FOR METALOG BUILDINGS

BACKGROUND OF THE INVENTION

1. Field of the Invention

This invention relates to buildings made of hollow "logs," typically formed of metal and often referred to as metalogs, and more particularly to a novel, inexpensive and highly effective foundation for such buildings. It relates also to a novel method of laying the foundation.

2. Description of the Prior Art

Log buildings have a long history, as indicated in applicant's co-pending U.S. patent applications Ser. Nos. 12/157,051, 12/218,913 and 12/287,832, filed respectively on June 6, July 18 and Oct. 14, 2008. Those applications and the applicant's prior U.S. Pat. Nos. 4,619,089 and 5,282,343, issued respectively on Oct. 28, 1986, and Feb. 1, 1994, are incorporated herein by reference.

Traditional log buildings made of wood have drawbacks, including the sheer weight and bulk of the logs and the consequent expense and difficulty of shipping and handling them; their lack of uniformity, even when trimmed to size; the inevitable waste, and, in many locales, the scarcity of wood. Because of these drawbacks, wooden structures today are usually not made of logs but are framed with sills, joists, studs, rafters, and ridgepoles and finished with interior and exterior sheathing.

The '089 and '343 patents identified above and corresponding patents in other countries disclose the best examples in the prior art of metalog construction. Buildings following their teachings have been erected in many parts of the world and are finding wide and growing acceptance. Government authorities and private builders in various countries have endorsed them for good reasons, including the following:

- they are suitable for residential and non-residential building construction;
- they do not burn and are resistant to damage by termites;
- galvanized steel or other metal or plastic material for forming the logs can be delivered to the building site as flat sheets and coils, with important savings in shipping costs;
- using compact machinery that can be moved from site to site, unskilled labor can form the strip material into lightweight hollow "logs" and cut them to the required length at the site with no waste;
- unskilled labor can easily position the logs by hand and use preformed end connectors to connect the logs in precise alignment;
- the hollow logs, because of the enclosed air chambers and the thinness of the material, have (even if made of a heat-conducting material such as steel) inherent insulating properties; and
- the time required for construction, from beginning to end, is but a fraction of the time required by traditional building methods, thereby making new construction quickly available on demand and reducing financing costs.

Before erecting any building, including one made of metal logs, it is usually necessary to prepare the ground. This involves clearing and possibly grading or excavating an area, and then pouring a concrete basement or slab foundation upon which to erect the superstructure. A concrete basement or slab, even for a relatively small structure, requires bringing to the site cement, adequate sand, water, iron rods and electro-welded mesh, as well as a skilled mason. None of this is too complicated in urban and sub-urban construction sites, but in some remote areas, pouring a concrete slab can represent a real problem in terms of logistics.

Financial constraints are another impediment to the construction of buildings in certain areas of countries with emerging economies. It is often necessary to construct buildings at bare minimum cost; saving the cost of a concrete foundation may make it possible to build much-needed, permanent building superstructures that could not otherwise be afforded.

OBJECTS AND SUMMARY OF THE INVENTION

An object of the invention is to remedy the problems of the prior art noted above. In particular, an object of the invention is to provide a novel construction method that obviates a conventional concrete foundation slab and to provide a novel structure using the method, thereby facilitating the erection of buildings in remote locations where the logistics involved in pouring a concrete foundation slab can be complicated and expensive.

Another object of the invention is to reduce the cost of erecting metalog building superstructures, thereby making such structures more readily available under circumstances wherein cost is of paramount importance.

BRIEF DESCRIPTION OF THE DRAWINGS

A better understanding of the objects, features and advantages of the invention can be gained from the following detailed description of the preferred embodiments thereof, in conjunction with the appended figures of the drawing, wherein.

DESCRIPTION OF PREFERRED EMBODIMENTS OF THE INVENTION

Relatively tiny superstructures in accordance with the present invention are robust enough to obviate a cement slab or foundation platform. This can be of importance in remote areas where the mere fact of having to pour a cement slab for a small building could represent a major complication. That is also where the present invention outperforms conventional alternatives. In accordance with the invention, the concrete slab that is usually poured as a foundation for inexpensive superstructures in remote locations, or the basement that is rarely poured as a foundation for such superstructures, is replaced by the superstructure's lowest or foundation metalogs, which are protected in a novel way.

In one embodiment of the invention, each of these special metalogs has a reinforcing mesh inserted into its interior. The mesh is preferably made of a strong but inexpensive metal such as steel but is optionally made of aluminum or a strong plastic such as Kevlar. In principle, it can even be made of carbon fibers or another relatively exotic material, but for economy, it is preferably made of an inexpensive material with the requisite reinforcing properties.

Before or after the superstructure is erected, these special metalogs are filled with mortar, polyurethane or another mix that, in combination with the reinforcing mesh, assures their structural soundness even if the metal skin of the metalogs decomposes in a few years because of contact with the ground.

In another embodiment, each of these special foundation metalogs is covered by a protective membrane, which may comprise synthetic material, asphalted material, another material as described below, or a combination thereof. This prevents degradation of the metalog that might otherwise occur because of its contact with the ground.

Optionally, both reinforcement and the membrane are used.

In any case, the flooring of such superstructures can be done in a locally conventional manner, with no cement, and the same is true of any exterior cladding that that may be applied to the entire superstructure. By way of example, the floor can be hardpan, with or without the addition of straw, and the cladding can be adobe, fiber-cement or asphalt shingles, or sheet metal.

Figure 1:
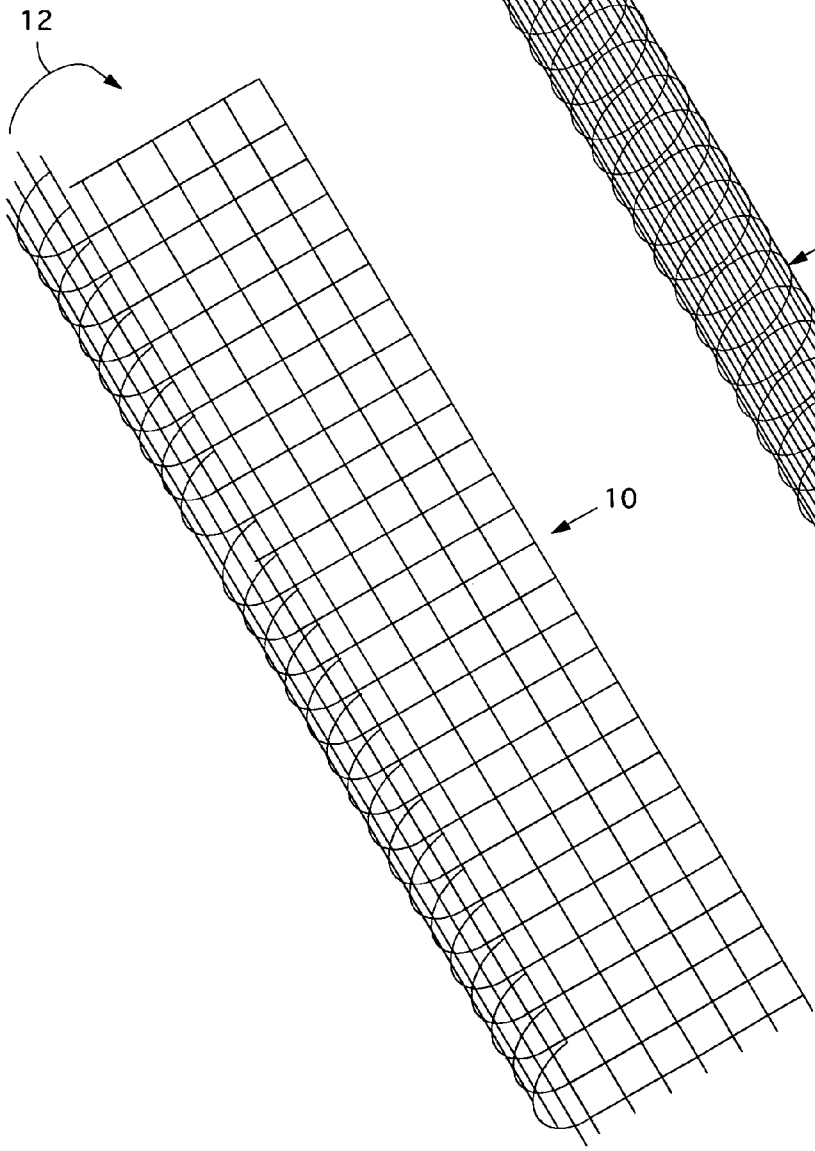
FIG. 1 is a perspective view of a mesh that has high tensile strength and can be shipped flat to a building site and showing a step in the curling of the mesh into a cylinder for use in accordance with the invention.
Figure 2:
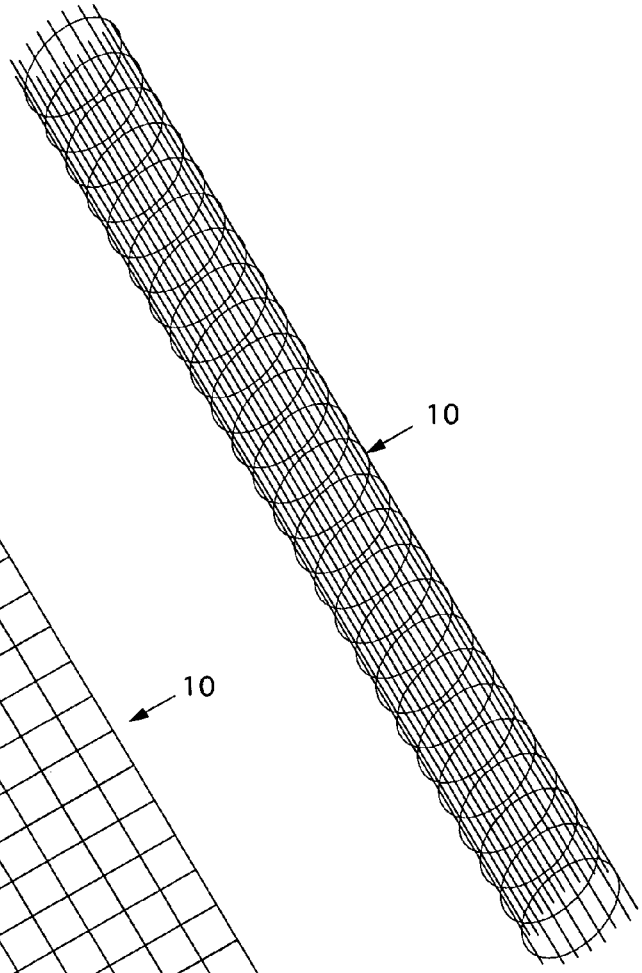
FIG. 2 is a perspective view of the mesh after the completion of the curling process.

FIG. 1 shows a metallic mesh 10 that can be shipped flat at little cost and curled at a building site as indicated by an arrow 12 into the cylindrical form shown in FIG. 2. The cylindrical mesh 10, preferably circular in cross section, is inserted into a metalog 14, also preferably circular in cross section, as indicated by an arrow 16 in FIG. 3.

Figures 3, 4, 25:
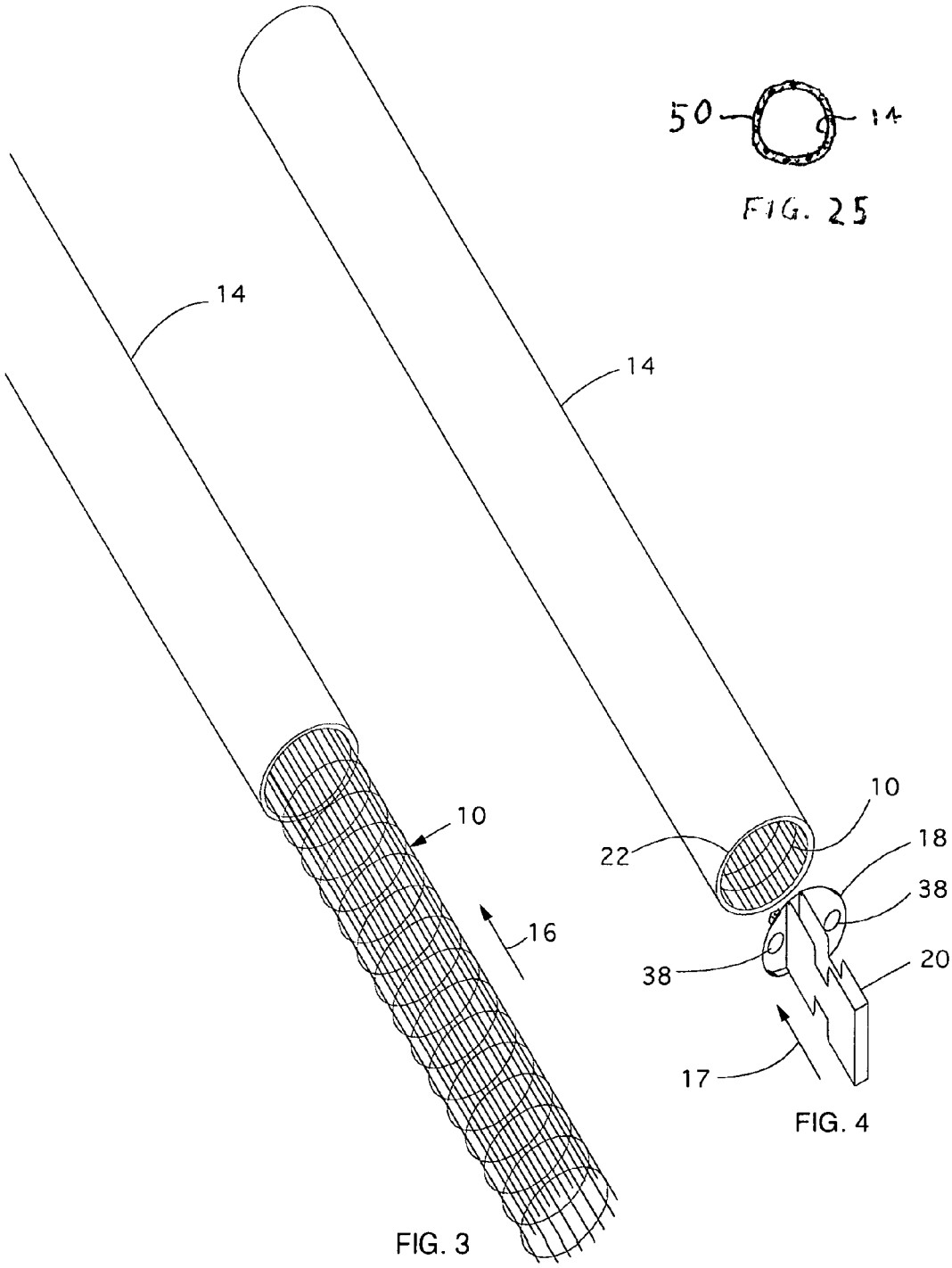
FIG. 3 is a perspective view showing the insertion of the cylindrical mesh into a hollow metalog.
FIG. 4 is a perspective view showing the mesh fully inserted into the metalog and the insertion into the metalog of an end cap and its associated connector.
FIG. 25 is a view in transverse cross section showing an embodiment of the invention in which a foundation metalog is surrounded by a protective membrane resistant to degradation by contact with the ground.
Figure 5:
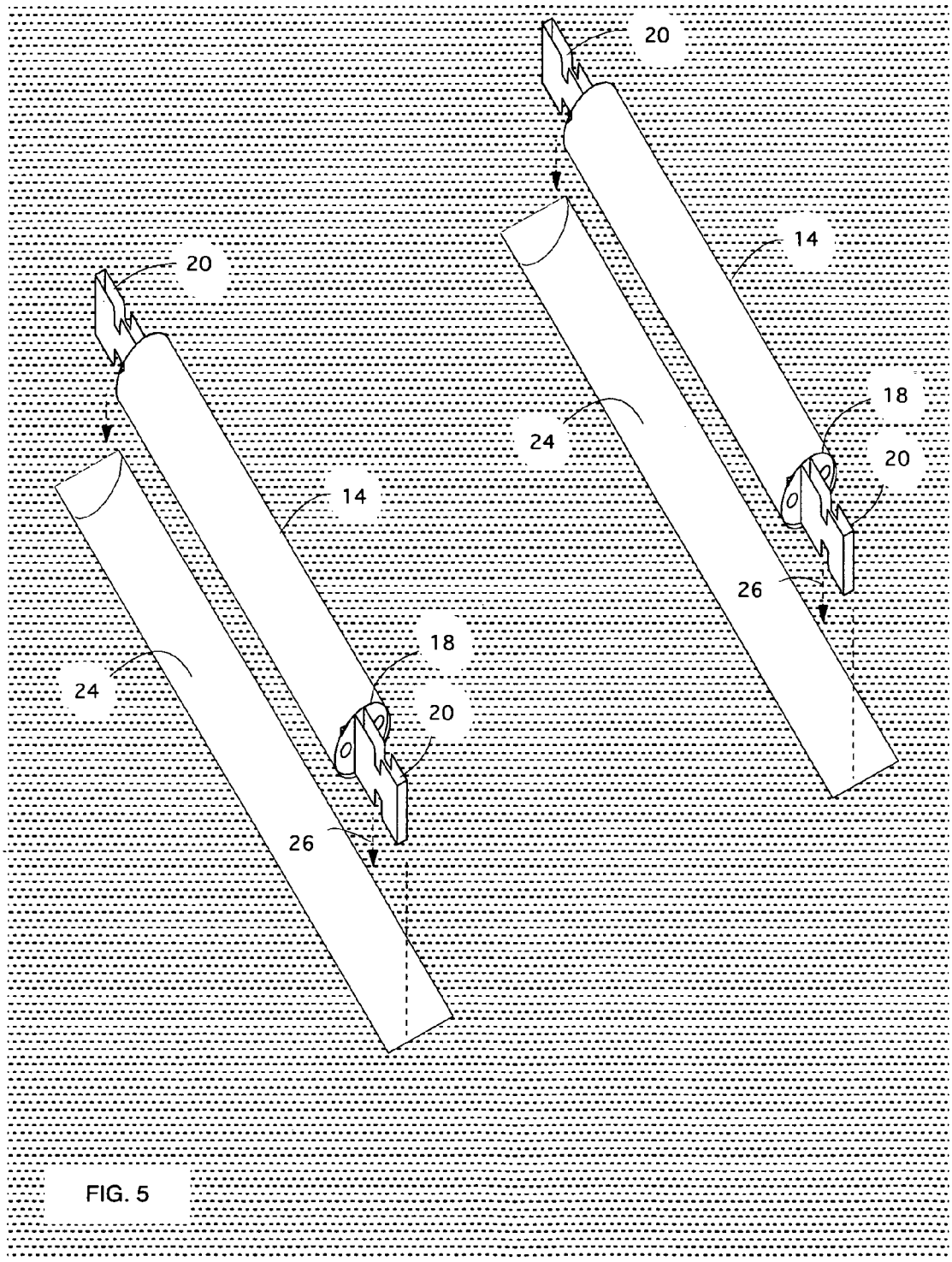
FIG. 5 is a perspective view showing the step of placing two metalogs prepared in accordance with the invention into respective trenches at a building site, where they serve as foundation metalogs.
Figure 6:
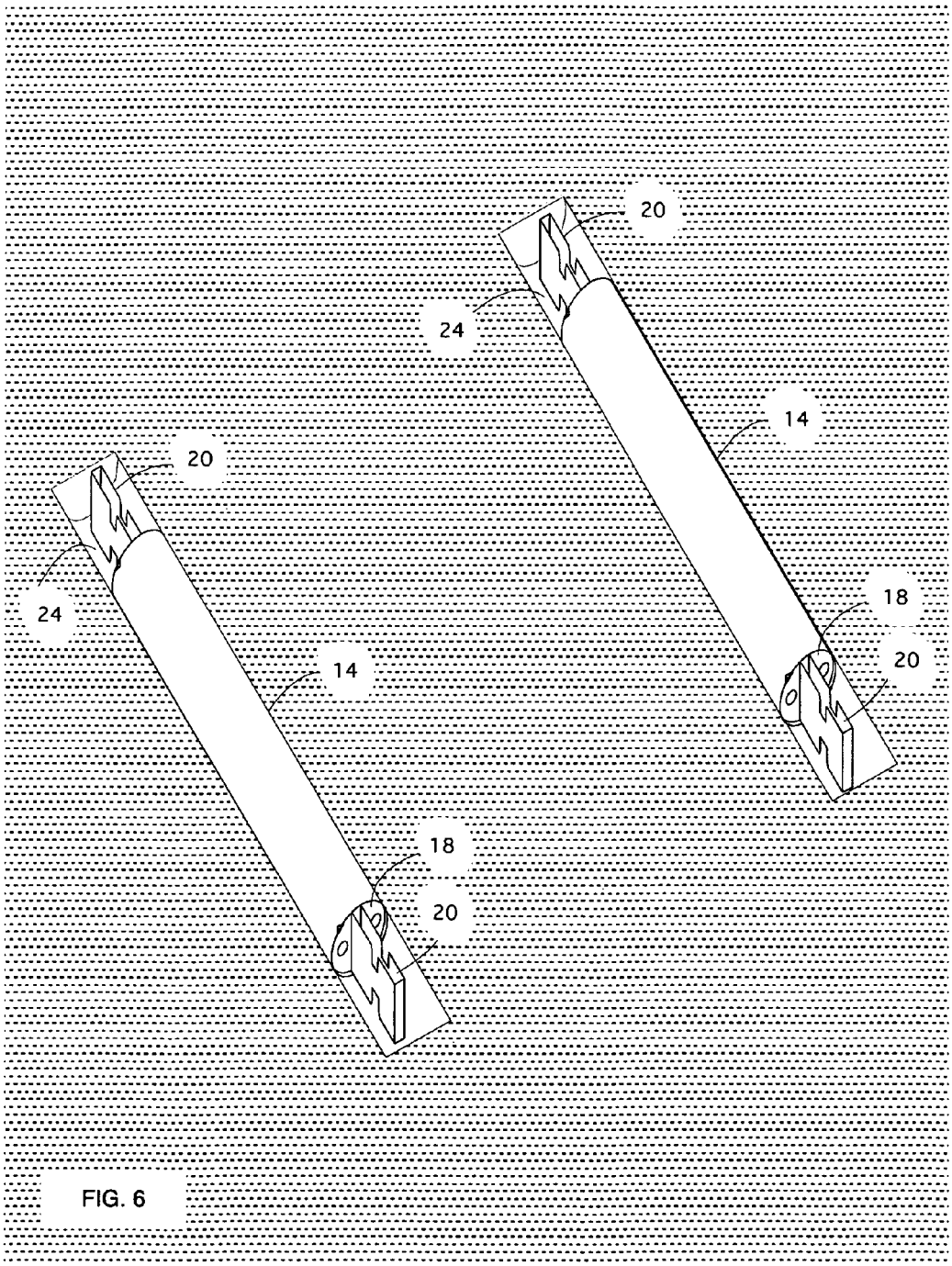
FIG. 6 is a perspective view showing the two foundation metalogs after placement in the respective trenches.

As an arrow 17 in FIG. 4 shows, an end cap 18 attached to a connector 20 is inserted into an end 22 of the metalog 14. Two foundation metalogs 14 prepared as described above and each having end caps 18 and connectors 20 at both ends are placed in trenches 24 as indicated by arrows 26 (FIG. 5). The trenches 24 are in parallel, spaced-apart relation, so that the entrenched foundation metalogs 14 are likewise in parallel, spaced-apart relation. FIG. 6 shows the entrenched foundation metalogs 14 at the end of that step.

Figure 7:
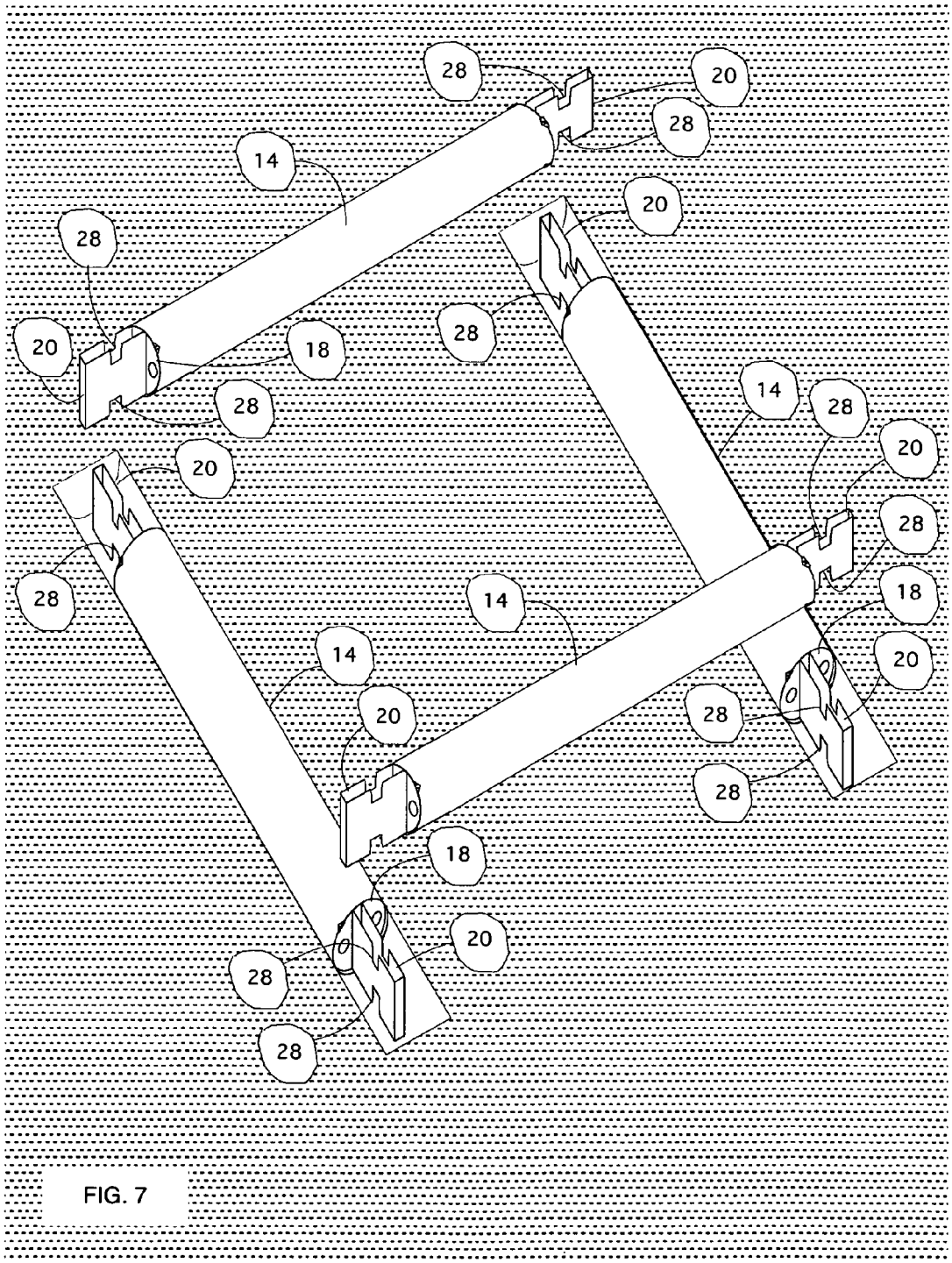
FIG. 7 is a perspective view showing the step of mounting two additional foundation metalogs atop the entrenched foundation metalogs, each of the additional foundation metalogs extending at right angles to the entrenched foundation metalogs.
Figure 8:
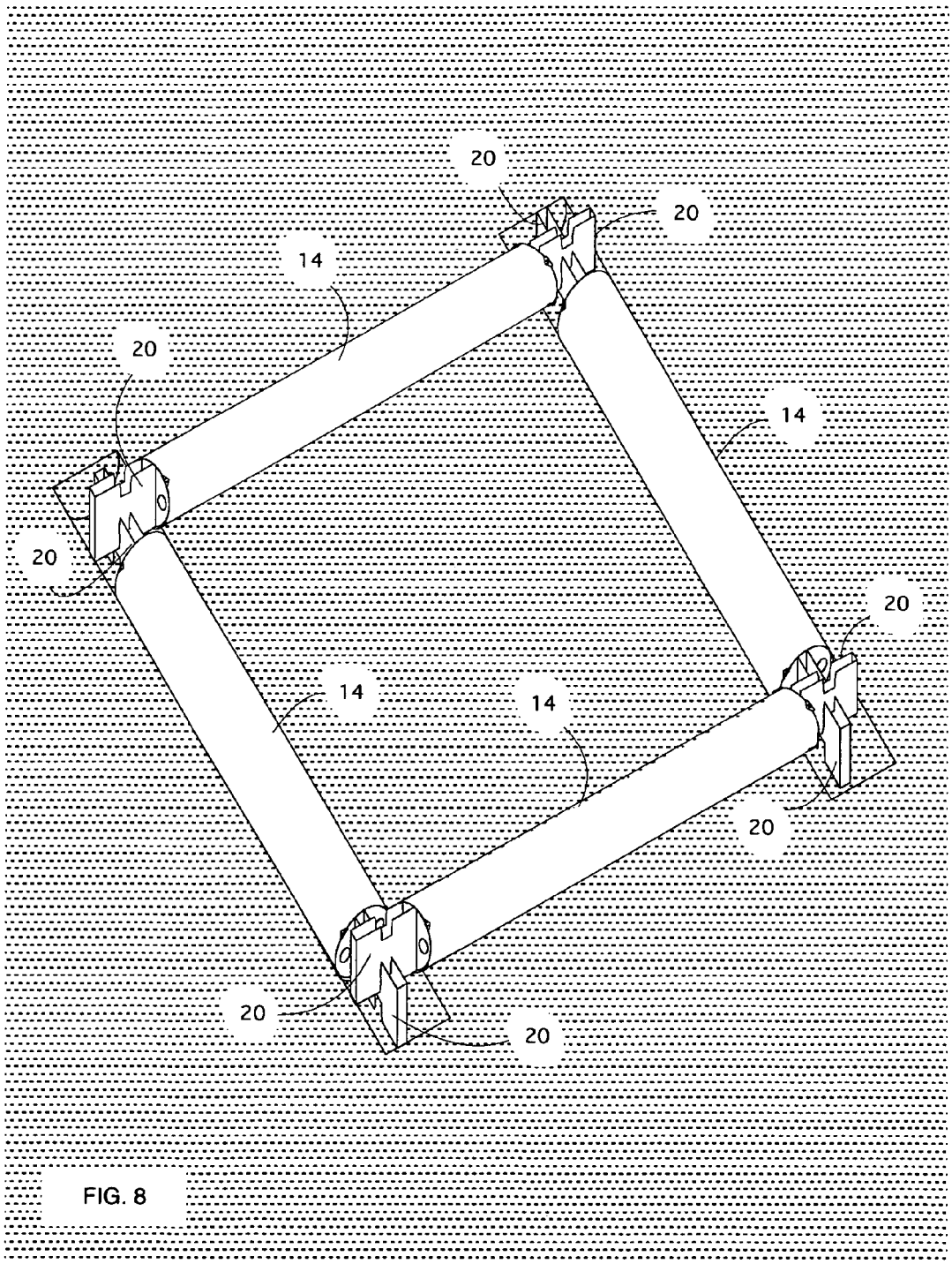
FIG. 8 is a perspective view showing the structure after completion of the step of mounting the two additional foundation metalogs.

FIG. 7 shows two additional foundation metalogs 14 about to be placed atop the two entrenched foundation metalogs. The two additional foundation metalogs 14 may or may not be entrenched but should be in contact with the ground, by piling up dirt around them if necessary, to keep out wind, water and vermin. All four foundation metalogs 14 have end caps 18 and connectors 20 at each end. The connectors 20 are H-shaped in elevation, and the cutout portions 28 at the top and bottom of each H (FIG. 7) enable the connectors 20 to fit together as shown in FIG. 8 to ensure a proper alignment of the metalogs 14.

Figure 9:
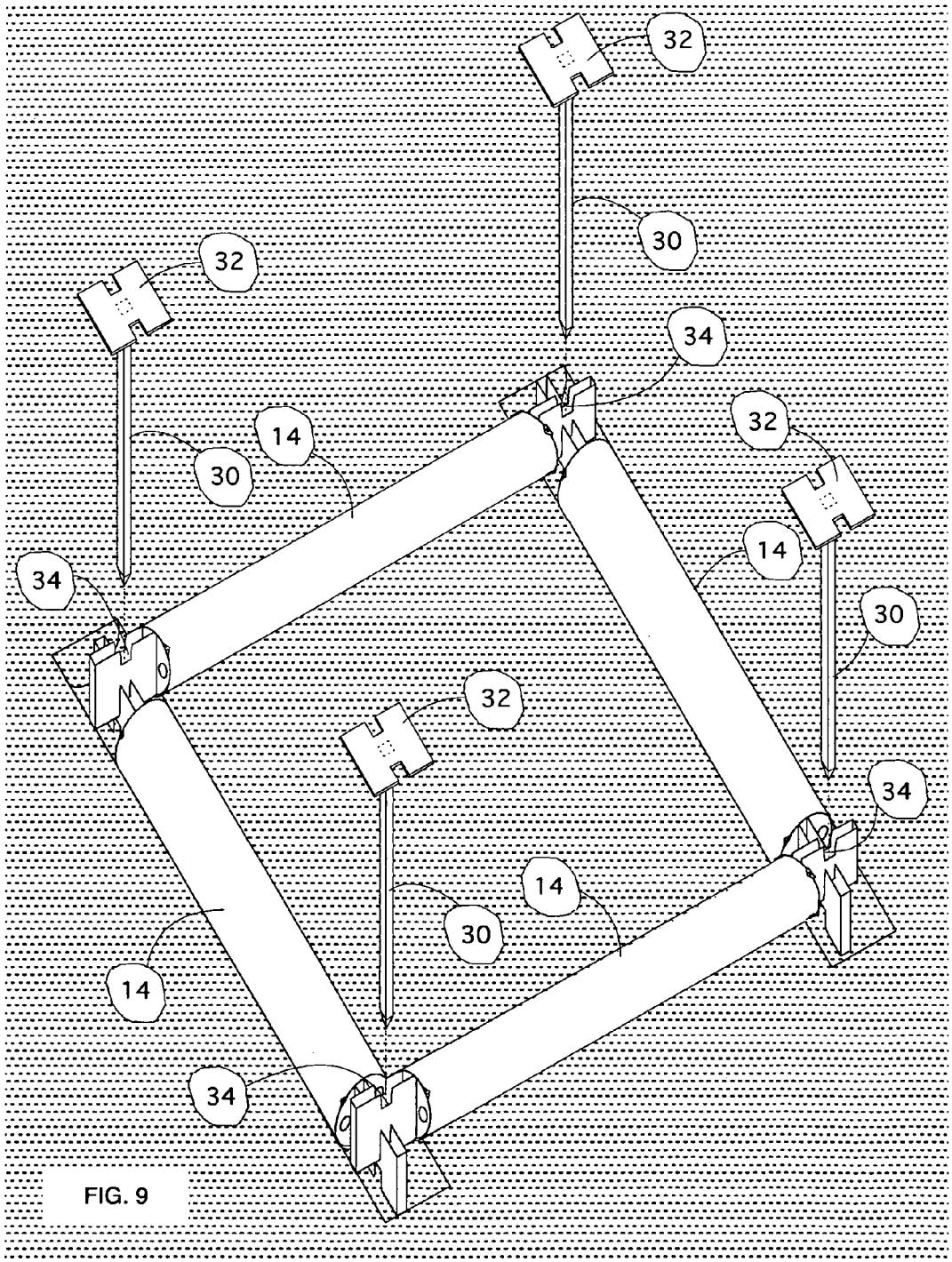
FIG. 9 is a perspective view showing the step of inserting four stakes through openings in the respective end connectors that connect the previously installed four foundation metalogs.
Figure 10:
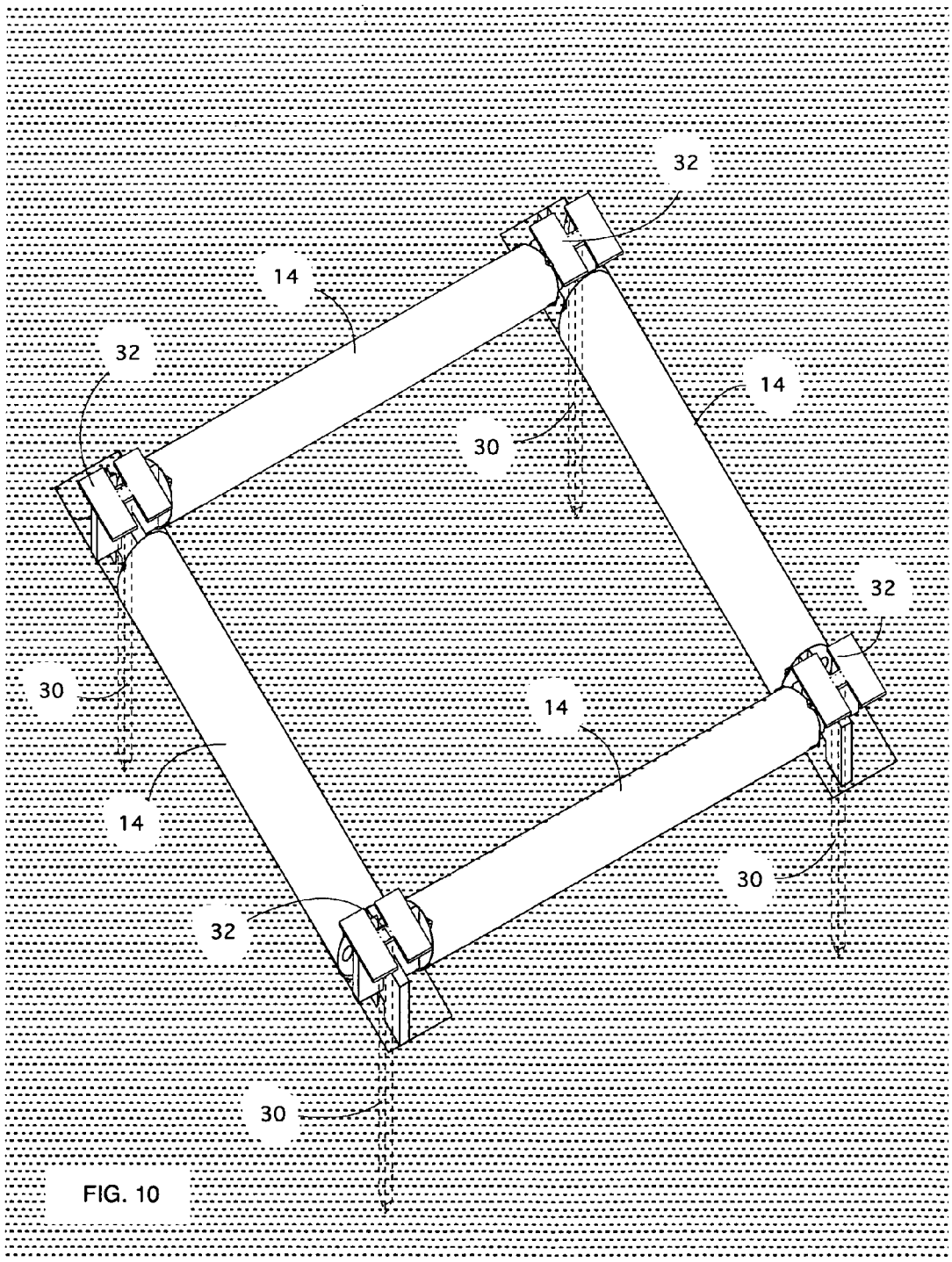
FIG. 10 is a perspective view showing the structure with the stakes driven into the ground to serve as a building anchor.

As FIG. 9 shows, stakes 30 are attached at their top ends to horizontally disposed H-shaped connectors 32; and as FIGS. 9 and 10 together show, the stakes 30 are inserted through aligned openings 34 in the connectors 20 and driven into the ground.

Figures 11, 12, 13, 14:
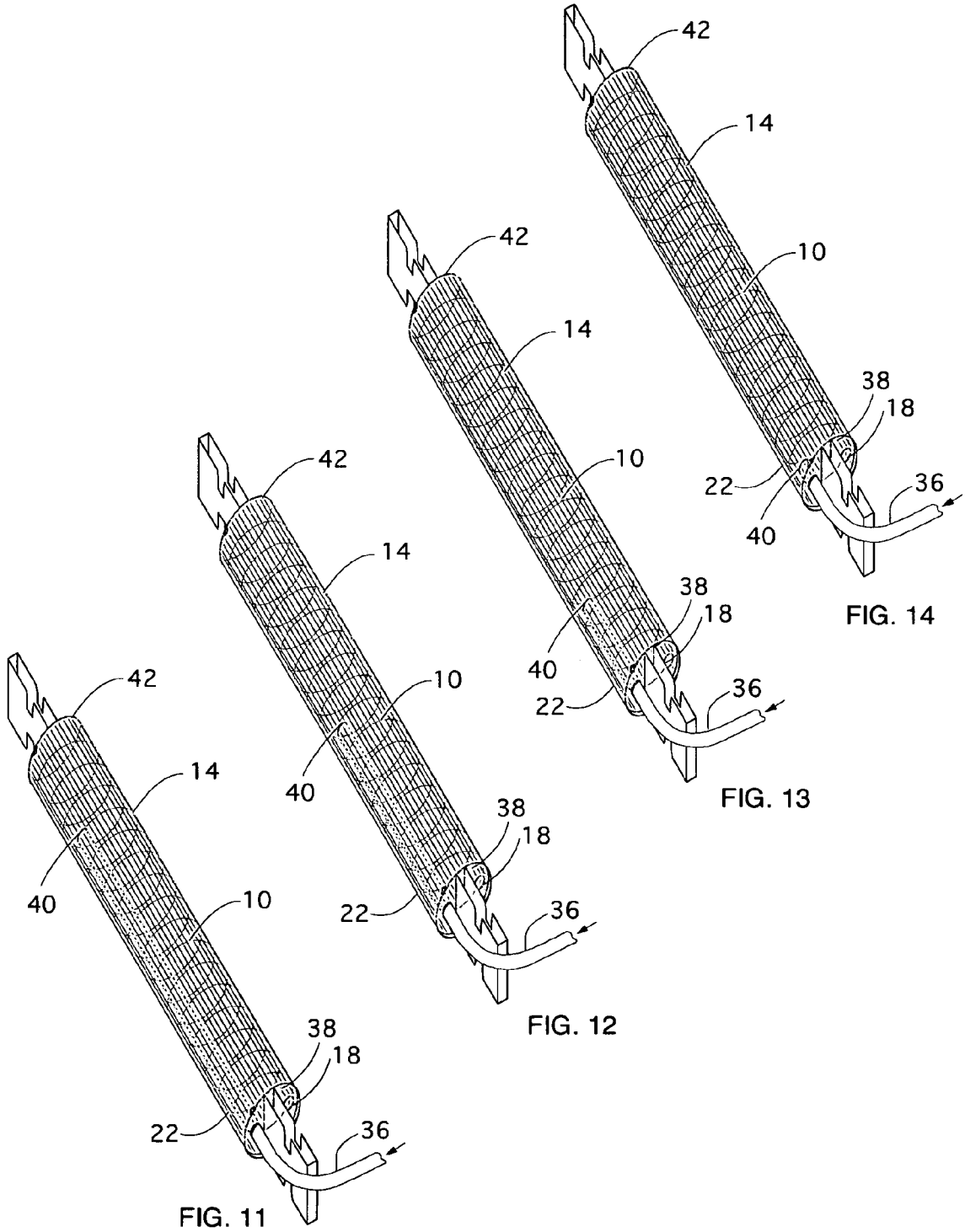
FIG. 11 is a perspective view, partly in phantom, showing the insertion of an injection hose into a metalog that has been prepared with an inserted mesh as described above for the purpose of injecting, at the distal end of the log, mortar, a thermosetting plastic, or another material that may have substantial weight and is resistant to degradation by any future contact with the ground.
FIGS. 12-14 are perspective views similar to FIG. 11 and showing the progressive withdrawal of the hose from the distal end of the metalog to the proximal end during the process of injecting the mortar or other material.
Figure 15:
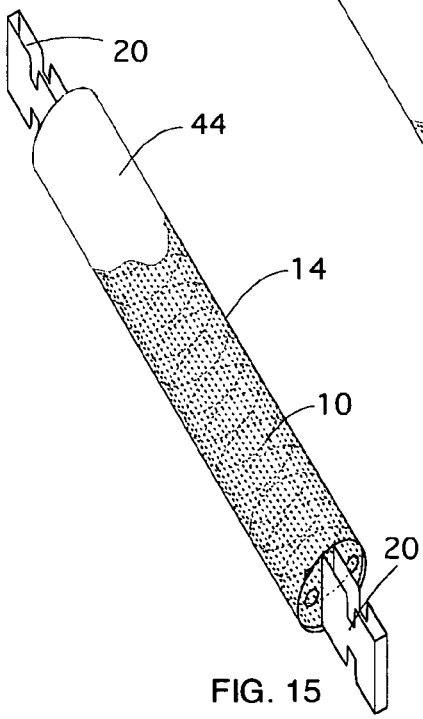
FIGS. 15-18 are perspective views corresponding to FIGS. 11-14, not showing the hose but showing the mortar or other material that is progressively injected into a first foundation metalog.
Figure 16:
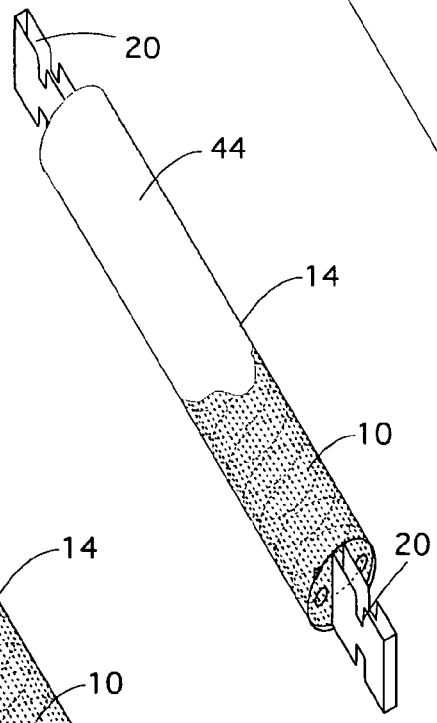
Figure 17:
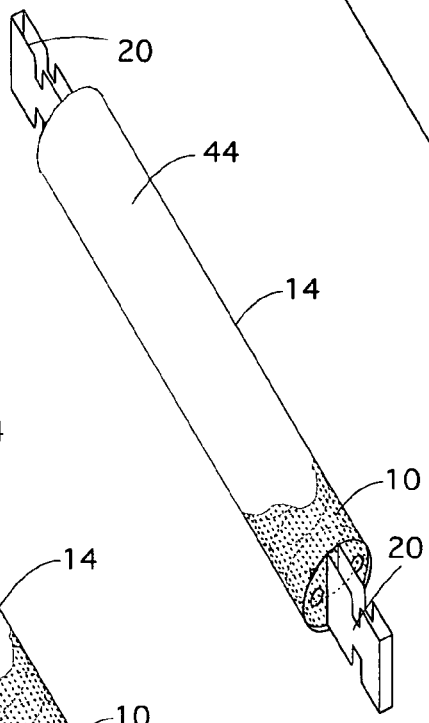

FIG. 11 shows a hose 36 inserted through one of a pair of openings 38 in the end cap 18 at the proximal end 22 of a foundation log 14. (FIG. 4 shows the openings 38 on a larger scale.) The distal end 40 of the hose 36 is extended substantially to the distal end 42 of the log 14. FIGS. 12-14 show the progressive withdrawal of the hose 36 from the log 14 as mortar or another material resistant to decay by contact with the ground is injected by the hose 36 into the interior of the log 14.

One of the two openings 38 in the end cap 18 at the proximal end 22 of the foundation log 14 is for insertion of the hose 36, as indicated above. The other opening 38 allows air to escape from the interior of the log 14 as mortar or another material is injected into the log 14 by the hose 36.

FIGS. 15-18 correspond respectively to FIGS. 11-14 but instead of showing the hose 36 show the mortar 44 or other material that the hose 36 progressively deposits within the hollow log 14 during the process of withdrawing the hose 36 from the log 14. The mortar or other suitable material 44 flows around the mesh 10, gradually cures, and seals the mesh 10 against moisture, protecting it indefinitely. Over time, the hollow log 14, which may be made of an inexpensive material such as galvanized steel, may disintegrate because of its direct contact with the ground, but the mortar or similar material 44 is resistant to decomposition. It and the mesh 10 remain securely in place. The weight of the mortar or other material 44 in combination with the stakes 30 anchors the superstructure and stabilizes it against high winds. The mortar has high resistance to compressive forces, and the mesh has high resistance to tensile forces.

Figure 19:
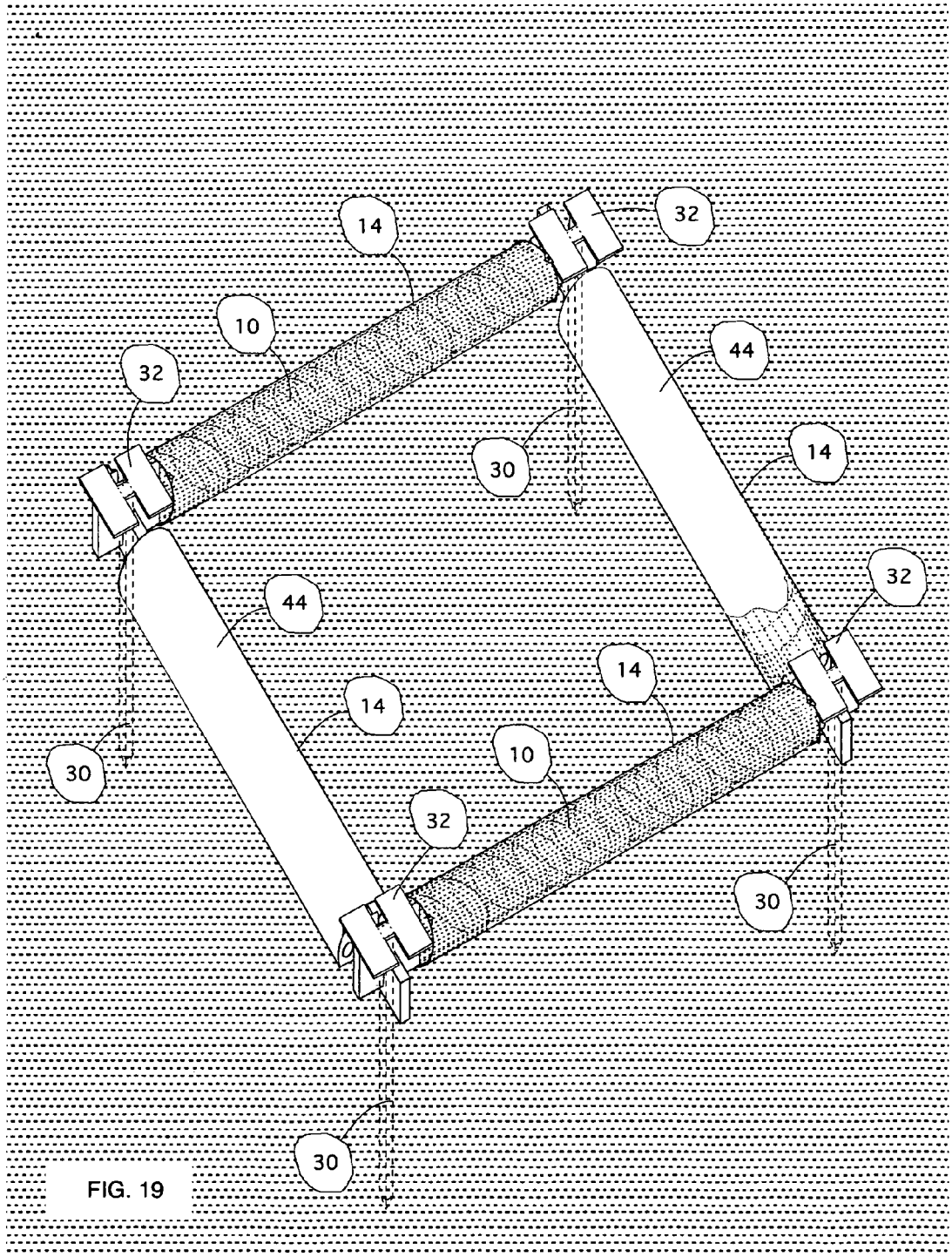
FIGS. 19-21 are perspective views, partly in phantom, showing the progressive injection of mortar or another suitable material into the remaining three foundation logs, the structure being shown in simplified form without the provision of doors, windows, etc.

FIG. 19 shows four foundation logs 14. The lower two are entrenched and in parallel, spaced-apart relation to each other. The upper two are not entrenched but are in contact with the ground. They are in parallel, spaced-apart relation to each other and extend at right angles to the entrenched logs, to which they are connected at their ends.

Figure 18:
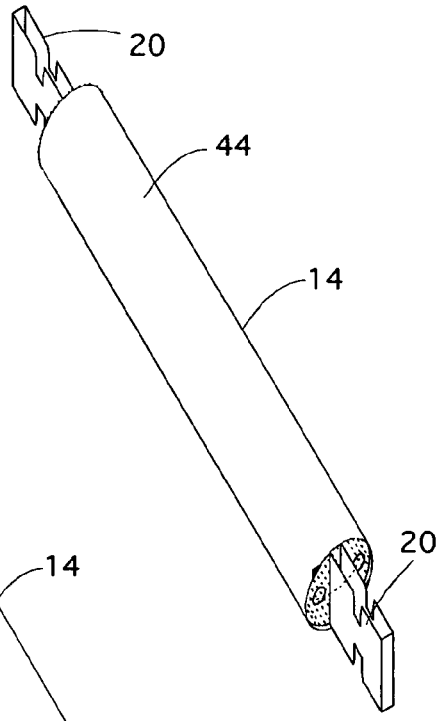

One of the entrenched foundation logs is depicted fully injected with mortar or another suitable material as in FIG. 18, and the other entrenched foundation log is depicted in the process of receiving mortar 44 or another suitable material. The two foundation logs that are not entrenched are shown awaiting their turn to receive the mortar or other material 44. FIG. 19 is partly in phantom to reveal portions of the mesh 10 not yet encased in the mortar or other material.

Figure 20:
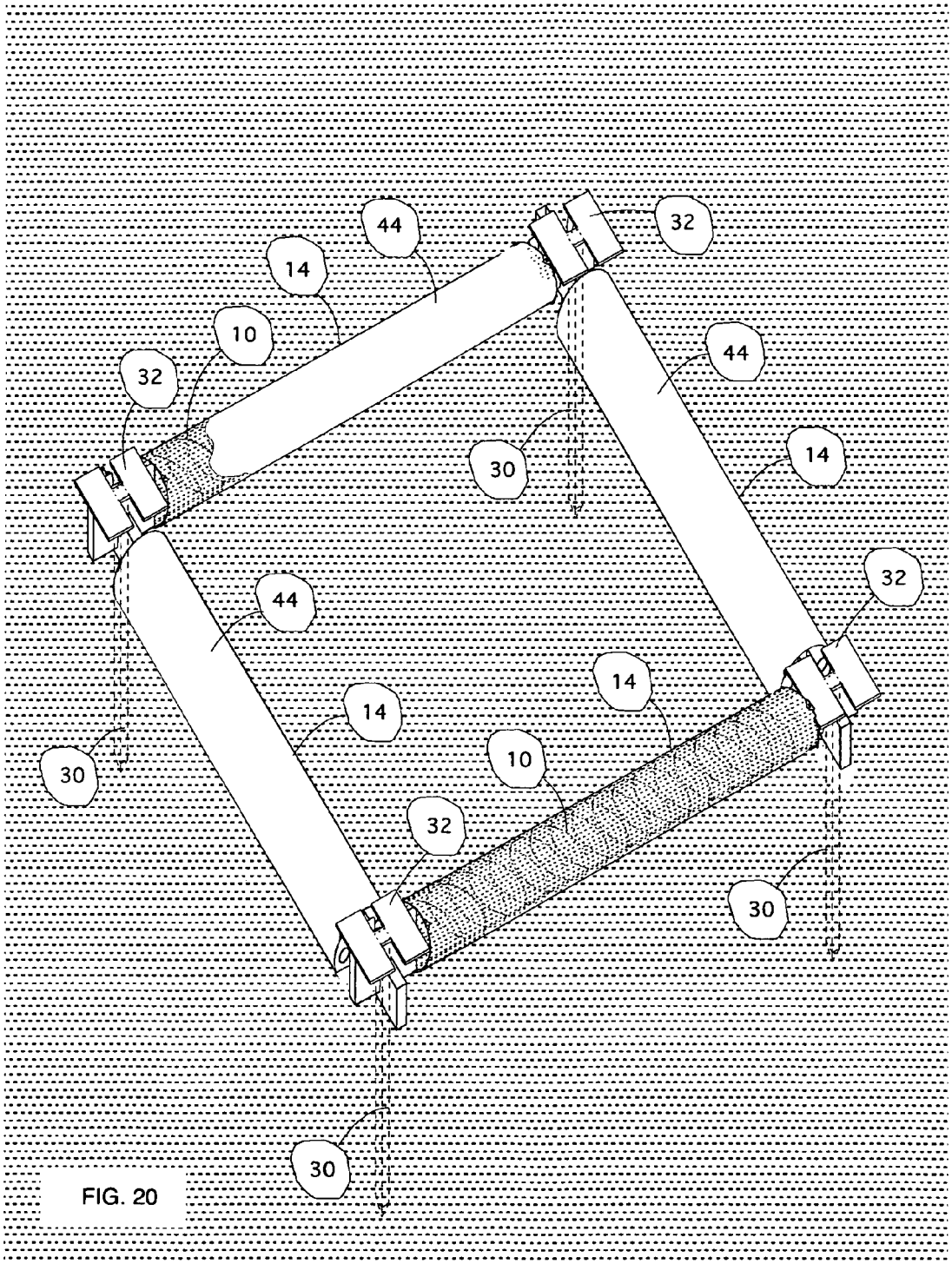
Figure 21:
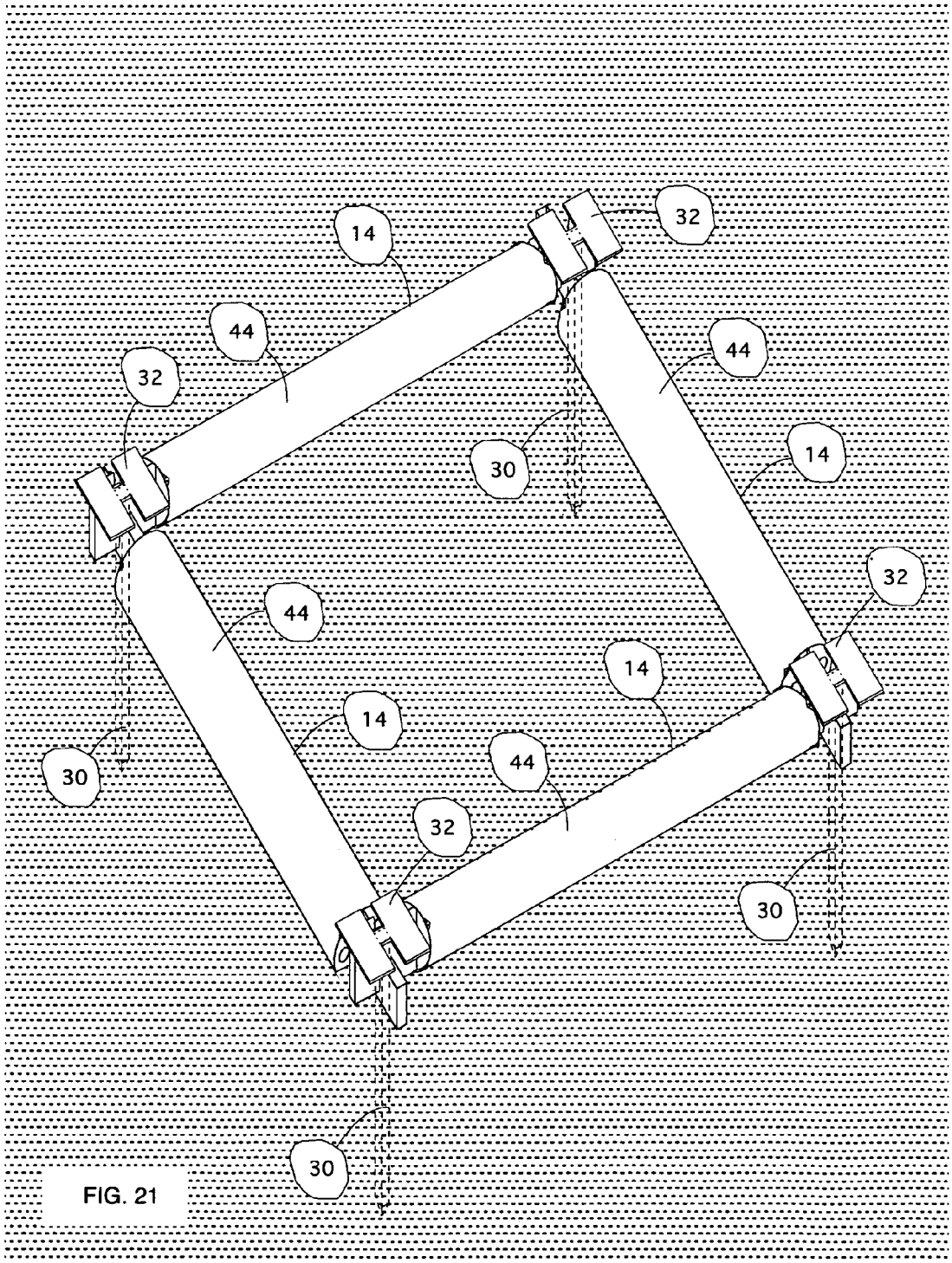

FIGS. 20 and 21 show a continuation of the process, which completes the installation of the foundation. In FIG. 21, all of the foundation logs 14 have been fully injected with mortar or another suitable material resistant to decay by contact with the ground. Even if the metal skin of the logs decays over time, the mortar or other suitable matrix material remains in place, and the reinforcing mesh embedded therein is protected against moisture. The structure described above, including the stakes, provides a secure anchor for the superstructure. Indeed, either the weighted metalogs or the stakes may independently provide a sufficient anchor under most conditions.

Figure 22:
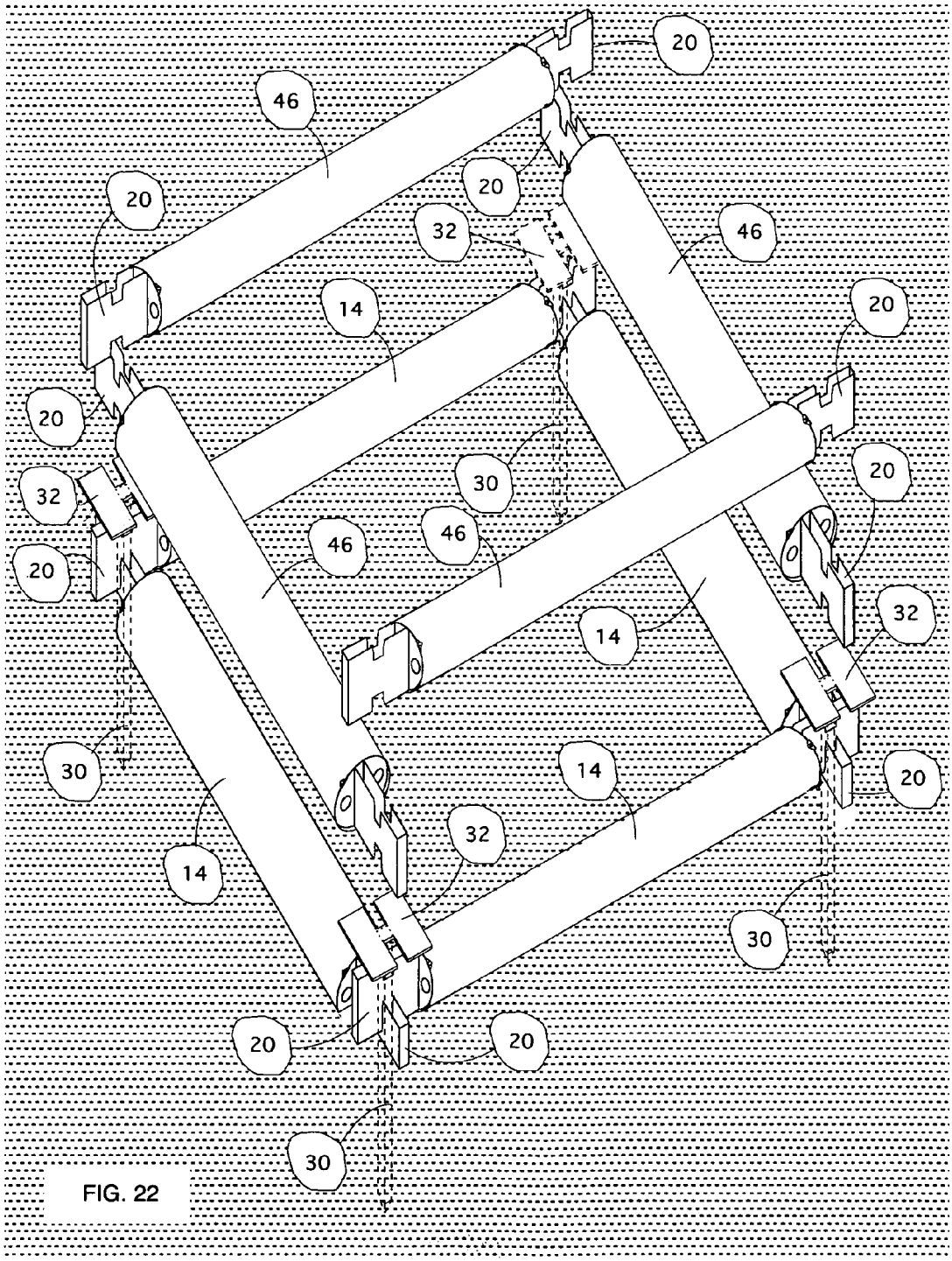
FIGS. 22 and 23 are perspective views similar to FIG. 21 and showing the installation of metalogs of conventional construction above the foundation logs.
Figure 23:
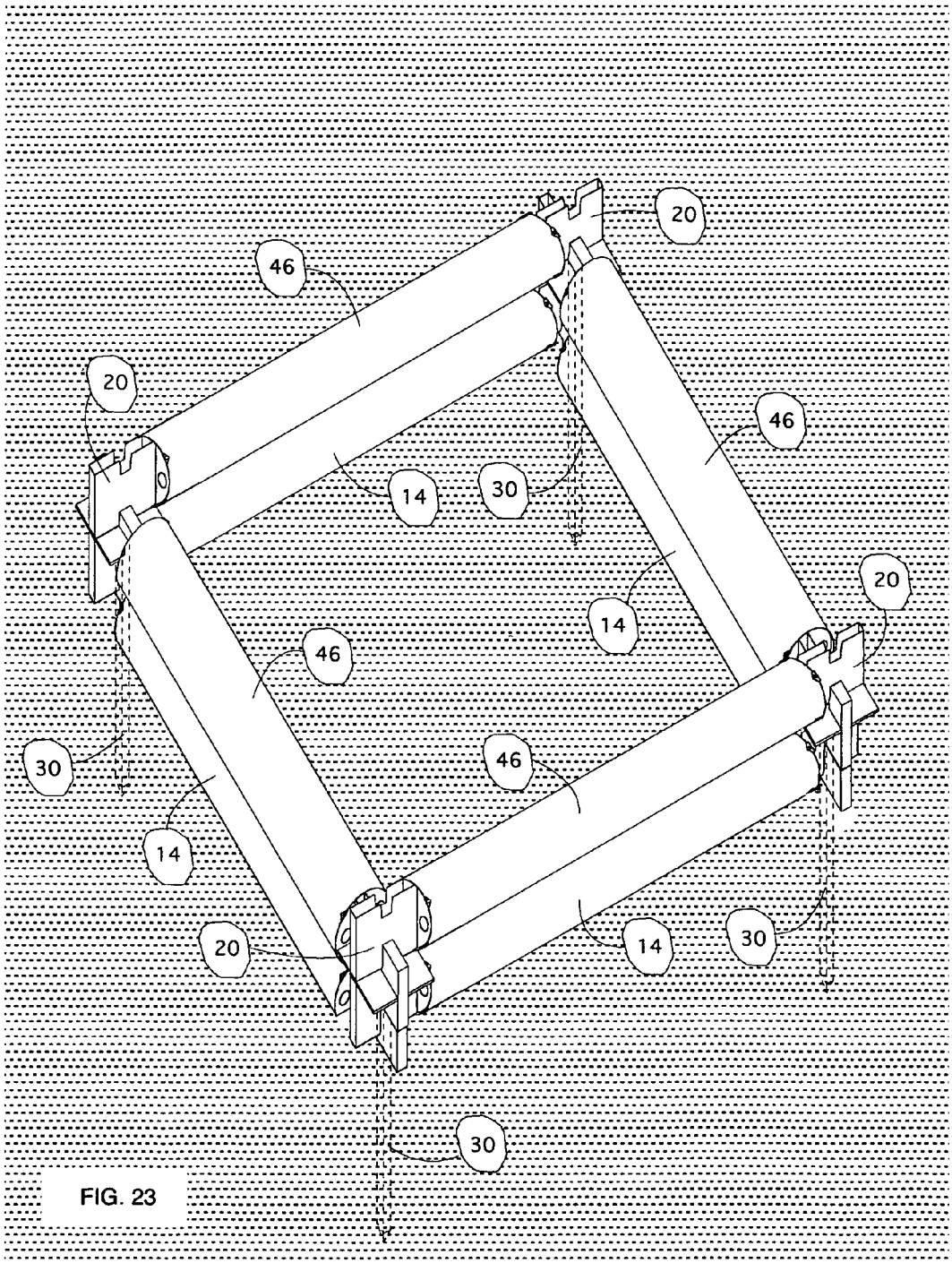
Figure 24:
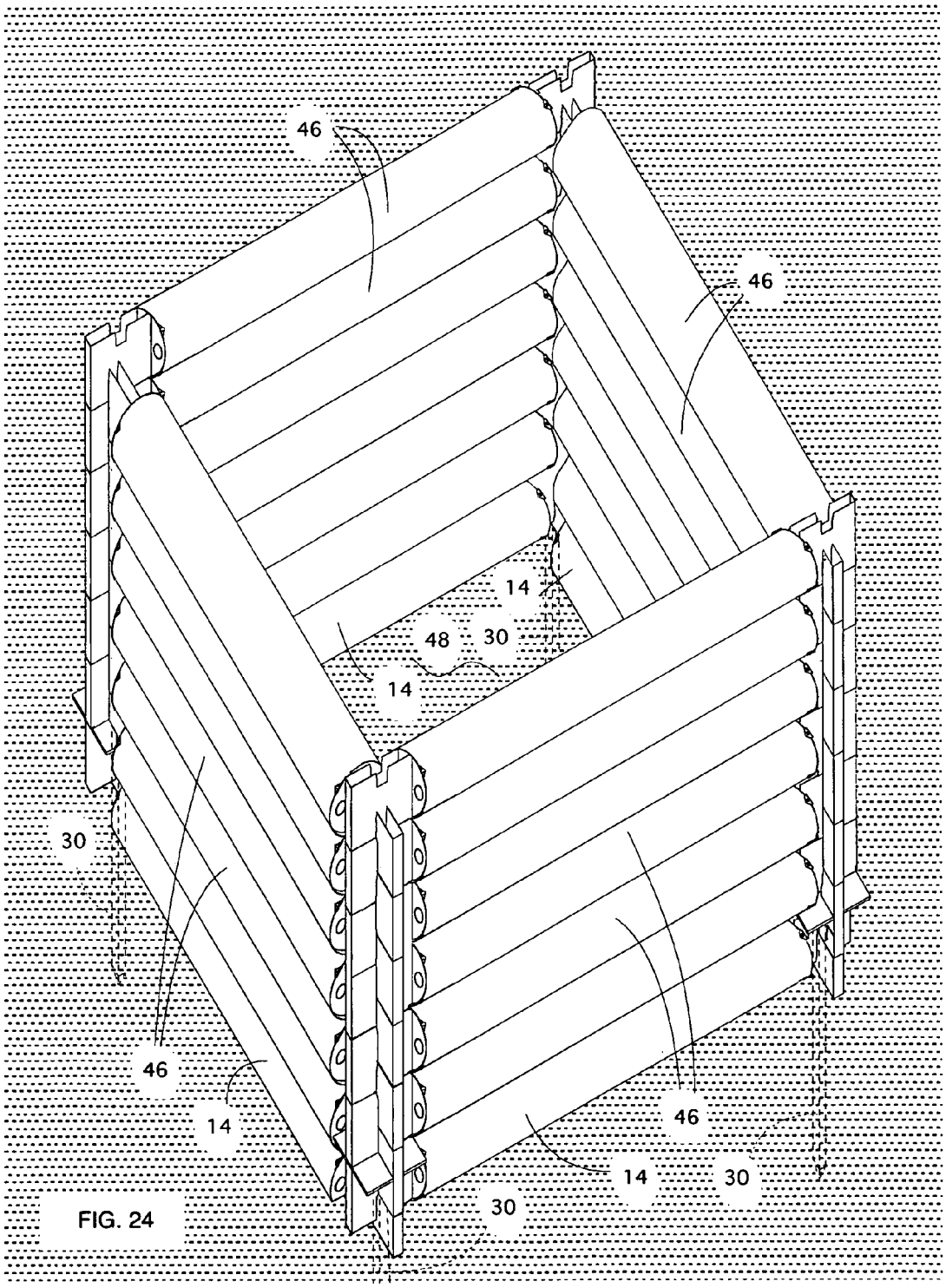
FIG. 24 is a perspective view showing the completion of four walls of a structure, again in simplified form without the provision of doors, windows, etc.

FIGS. 22-24 show in a schematic way the erection of the superstructure. Conventional hollow metalogs 46, which are not mounted in contact with the ground, need not be prepared in the novel way described above. However, they have end caps and connectors and fit together as described above.

FIG. 22 shows four logs 46 about to be placed atop the foundation logs 14, and FIG. 23 shows the logs 46 after their emplacement. FIG. 24 shows the completed structure in a simplified way, omitting doors, windows, roof, etc., but showing four walls meeting at respective right dihedral angles and enclosing an interior space. FIG. 24 also shows that the ground (especially if hardpan) can serve as the floor 48.

FIG. 25 is a view in transverse cross section showing a foundation metalog 14 surrounded by a protective membrane 50 that is made of butyl or PVC, fusion tape, waterproof flashing such as pitch or tar, or any other suitable water-impermeable and weather-resistant sealing material. The membrane 50 is shaped conformably to the exterior of the tube and resistant to degradation by contact with the ground. Optionally, even though the interior surface of a foundation metalog does not contact the ground, each foundation metalog 14 may be hermetically sealed against the elements so that both the interior and exterior surfaces of the metalog 14 are protected.

The end caps 18 (one of which is shown schematically from the inside of a metalog 14 in FIG. 25) at either end of the foundation metalogs 14 may be covered and protected by the membrane 50 or made of a material such as stainless steel that is resistant to degradation by contact with the ground.

In the former case, the connectors 20 pierce the protective membrane 50 that wraps the foundation metalog 14, so that the connectors 20 can lock together as described above.

In the latter case, the end caps 18 can be sealed to the metalog 14 by sealing tape made of butyl or PVC, by fusion tape, by waterproof flashing such as pitch or tar, or by any other suitable water-impermeable sealing material. If no mortar or other material is to be injected into the interior of the metalog, then, as FIG. 25 shows, the openings 38 shown for example in FIG. 4 need not be provided.

In either case, the connectors 20 connecting the foundation metalogs 14 are ideally made of a material such as stainless steel that is resistant to degradation by contact with the ground.

Thus there is provided in accordance with the invention a novel and highly effective building foundation and a method for its construction. Modifications of the preferred embodiments of the invention as disclosed herein will readily occur to those skilled in the art upon consideration of the appended drawings and preceding description. The invention includes all modifications thereof that are within the scope of the appended claims.

The invention claimed is:

1. A foundation for a building superstructure, the foundation comprising a tube entrenched in the ground, having two ends, susceptible to degradation by contact with the ground, and having a hollow interior; and protection against degradation by contact with the ground selected from the group consisting of:

a reinforcement housed within the tube, shaped conformably to the interior of the tube, and resistant to degradation by contact with the ground, a protective membrane surrounding the tube, shaped conformably to the exterior of the tube, and resistant to degradation by contact with the ground, and a combination thereof;

wherein the foundation further comprises end connectors respectively connected to ends of the tube, wherein the end connectors are respectively formed with openings; and stakes passed through the openings in the end connectors and into the ground to serve as a foundation anchor.

2. A foundation according to claim 1 wherein the tube is circular in cross section.

3. A foundation according to claim 1 wherein the tube comprises a material selected from the group consisting of metal and plastic.

4. A foundation according to claim 1 wherein the membrane comprises a material selected from the group consisting of synthetic material, asphalted material, and a combination thereof.

5. A foundation according to claim 1 wherein the reinforcement comprises a first part resistant primarily to tensile forces and a second part resistant primarily to compressive forces and bonded to the first part.

6. A foundation according to claim 5 wherein the first part comprises a mesh and the second part comprises a cured matrix material.

7. A foundation according to claim 6 wherein the mesh comprises a material selected from the group consisting of a metal, a plastic, and a combination thereof.

8. A foundation according to claim 6 wherein the mesh comprises a material selected from the group consisting of steel, a synthetic material, and a combination thereof.

9. A foundation according to claim 6 wherein the matrix material is selected from the group consisting of mortar, polyurethane, a synthetic material, and a combination of two or more thereof.

10. A building comprising: a foundation according to claim 1; and a building superstructure comprising a plurality of hollow tubes stacked on the foundation in parallel relation to form a wall.

11. A building comprising: a foundation having a plurality of tubes entrenched in the ground and meeting at angles with one another, each tube having two ends, susceptible to degradation by contact with the ground, and having a hollow interior; and each tube having protection against degradation by contact with the ground selected from the group consisting of: a reinforcement housed within the tubes, shaped conformably to the interior of the tubes, and resistant to degradation by contact with the ground; a protective membrane surrounding the tubes, shaped conformably to the exterior of the tubes, and resistant to degradation by contact with the ground; and a combination thereof; wherein the foundation further comprises end connectors respectively connected to ends of the tubes, wherein the end connectors are respectively formed with aligned openings; and stakes passed through the openings in the end connectors and into the ground to serve as a foundation anchor; and a building superstructure comprising a plurality of hollow tubes stacked on the foundation to form a plurality of walls meeting at dihedral angles with one another and enclosing a space.

12. A building according to claim 11 wherein the enclosed space has a floor formed by the ground.

13. A method of making a foundation according to claim 1 comprising the steps of selecting a tube susceptible of degradation by contact with the ground and having a hollow interior, inserting a first material resistant primarily to tensile forces into the hollow interior, inserting a second material resistant primarily to compressive forces and resistant to degradation by contact with the ground into the hollow interior for curing and bonding with the first material, and placing the tube with the contained first and second materials in contact with the ground to serve as a foundation for a building superstructure.

14. A method according to claim 13 comprising the steps of selecting a flat mesh as the first material and curling the mesh into a tubular shape for insertion into the hollow interior.

15. A method according to claim 13 comprising the step of forming a trench in the ground to accommodate the tube with the contained first and second materials.

16. A method according to claim 15 comprising the step of inserting an end connector into the tube to enable connection of the end connector to another tube of similar construction, and staking the end connector to the ground.

* * * * *